United States Patent [19]

Sasayama et al.

[11] 4,033,107

[45] July 5, 1977

[54] METHOD AND APPARATUS FOR CONTROLLING DRIVING OPERATION OF OPEN-END SPINNING FRAME

[75] Inventors: Chikanobu Sasayama, Fukui; Osamu Suzuki, Oobu; Takeshi Shimizu; Kunji Chiba, both of Kariya, all of Japan

[73] Assignees: Kabushiki Kaisha Toyoda Jidoshokki Seisakusho; Daiwa Boseki Kabushiki Kaisha, Osaka, both of Japan

[22] Filed: May 22, 1975

[21] Appl. No.: 580,058

[52] U.S. Cl. ..... 57/81; 57/34 R; 57/78

[51] Int. Cl.[2] ..... B65H 63/08; B65H 61/00

[58] Field of Search ..... 57/34 R, 58,89–58.95, 57/78–81, 83

[56] References Cited

UNITED STATES PATENTS

| | | | |
|---|---|---|---|
| 3,029,588 | 4/1962 | Davis | 57/78 |
| 3,163,977 | 1/1965 | Weiss | 57/81 X |
| 3,169,361 | 2/1965 | White | 57/81 X |
| 3,354,626 | 11/1967 | Cizek et al. | 57/78 |
| 3,541,774 | 11/1970 | Sterba et al. | 57/81 X |
| 3,695,017 | 10/1972 | Hori et al. | 57/58.95 X |
| 3,879,926 | 4/1975 | Bartling et al. | 57/58.95 |
| 3,882,663 | 5/1975 | Soukup et al. | 57/34 R |
| 3,892,062 | 7/1975 | Stahlecker et al. | 57/58.89 X |
| 3,988,879 | 11/1976 | Franzolini et al. | 57/78 X |

*Primary Examiner*—Donald Watkins
*Attorney, Agent, or Firm*—Burgess, Ryan and Wayne

[57] ABSTRACT

Method and apparatus for controlling the operation of the open-end spinning frame which comprises measuring the number of rotations of the take-up roller means or a winding roller, controlling the relative timing of the reverse rotation of the take-up roller means and a winding roller of each spinning unit in association with the time of starting the normal driving of the fiber supply roller of each spinning unit and the time of starting the normal driving of the take-up roller and the winding roller based on the measured number of said rotations, and controlling the relative timing of the time of stopping the driving of the take-up roller and the winding roller in associated with the time of stopping the fiber supply roller based on the measured number of rotations.

8 Claims, 8 Drawing Figures

MS
32
PB1
PB2
MS
MS
MS
TR30
TR30
CR1
DC1
CR2
CR2
DC2
CR3
CR3
34
DC3
35
36
37
MS
46
CR1
DC1
CR1
DC2
CR3
CR1
CR2
DC3
CR3
CR1
27
CR2
21
CR3
22
CR1
CR3
28
CR3
CR2
40

PB1
MS
MS
32
TR30
TR30
CR1
CR1
TR1
TR2
27
CR1
28
TR1
t30
t1
t2
1
2
2
26
3
27
4
5
28
6
7
8
9
10
11
12
38
13
14
19
23
39
29
30
25

METHOD AND APPARATUS FOR CONTROLLING DRIVING OPERATION OF OPEN-END SPINNING FRAME

SUMMARY OF THE INVENTION

The present invention relates to an improved method and apparatus for controlling the driving operation of the open-end spinning frame.

In the conventional open-end spinning frame provided with a plurality of spinning units, each spinning unit comprises a spinning rotor, a roller means for supplying fibers into the spinning rotor, a take-up roller means for delivering a yarn from the spinning rotor and a winding roller for forming a yarn package from the yarn delivered from the take-up roller means. When a tail end of a leading yarn wound around a bobbin rotatably mounted on the winding roller is firstly introduced into the spinning rotor, so as to automatically join it with a leading end of a fresh yarn formed in the spinning rotor, the take-up roller means and the winding roller are temporarily forced to rotate in directions opposite to their normal driving directions so that the tail end of the above-mentioned leading yarn is introduced into the spinning rotor. The normal driving of the supply roller means is commenced during the above-mentioned reverse driving of the take-up roller means and the winding roller. After a predetermined time of the above-mentioned operation wherein the tail end of the leading yarn is joined to fibers accumulated in the spinning rotor, normal driving of the take-up roller means and the winding roller is commenced so as to carry the normal spinning operation. To carry out the above-mentioned starting operation of the open-end spinning frame, a suitable mechanism for controlling the time of the above-mentioned driving elements is utilized. On the other hand, when it is required to stop the spinning operation, firstly the fiber supply roller means is stopped and, after a predetermined time from the above-mentioned stopping of the supply roller means, the driving of the take-up roller means and the driving of the winding roller are stopped simultaneously. The timing of these operation for stopping the driving elements is controlled by the above-mentioned control mechanism so as to reserve a tail end of the yarn taken up by the take-up roller means in a delivery tube of the spinning rotor. This is because such tail end reservation in the delivery tube makes it easy to join such a reserved tail end with the fibers accumulated in the spinning rotor when the next spinning operation is commenced.

The above-mentioned control of the operation of driving elements is preferably carried out by utilizing timing instruments of the control mechanism. Therefore, it is very important to set the timing relation between the operations of the above-mentioned driving elements so as to carry out the spinning operation without trouble. However, according to our experience, since the pertinent condition of the above-mentioned timing relation should be changed so as to fit variable conditions due to the variety of fiber materials, spinning count of yarn, production speed etc, it is very difficult to find a practical and pertinent condition of the timing relation. Further, it is troublesome to change the condition of the above-mentioned timing relation in order to fit the variable conditions.

The principal object of the present invention is to provide an improved method and apparatus for controlling the driving operation of the open-end spinning frame so that the above-mentioned drawbacks of the conventional method and apparatus can be eliminated.

To attain the purpose of the present invention, the apparatus for controlling the driving operation of the open-end spinning frame is mounted on the spinning frame in a condition associated with the driving mechanism of each spinning unit wherein the fiber supply roller means, the take-up roller means and the winding roller are driven by a driving motor by way of the corresponding gear train provided with the respective magnetic clutches and the driving shafts of these driven elements provided with respective magnetic brakes. Further, a timing means for measuring the number of rotations is mounted on the driving shaft of the take-up roller or the driving shaft of the winding roller, and an electric control circuit, which is actuated by an output signal of the timing means, is mounted on a control panel secured to the machine frame so as to control the actuation of the above-mentioned magnetic clutches and magnetic brakes when the timing means issues a signal in a timing which satisfies the above-mentioned timing relation of the driving elements. Therefore, very effective controlling the driving operation of the open-end spinning frame at the time of commencing the normal spinning operation and at the time of stopping the normal spinning operation can be accomplished.

DETAILED EXPLANATION OF THE PRESENT INVENTION

Figure 1:
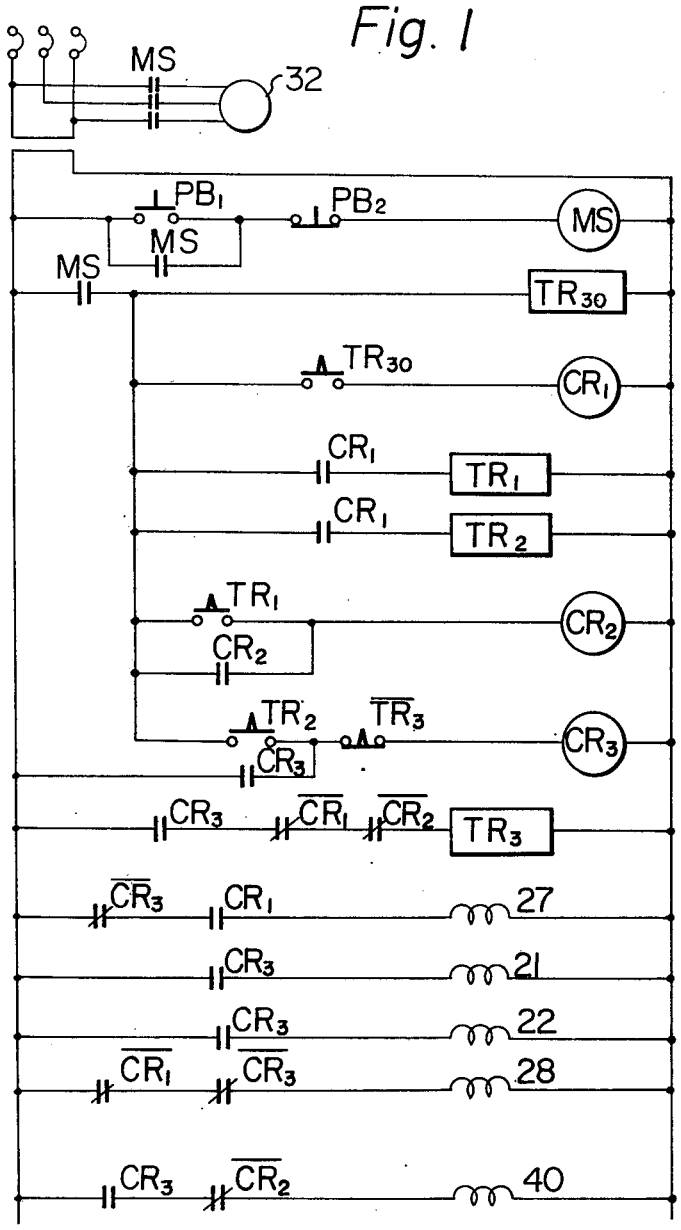
FIG. 1 is a diagram of an electric circuit utilized with a conventional timing means for controlling the driving operation of the open-end spinning frame.
Figure 2:
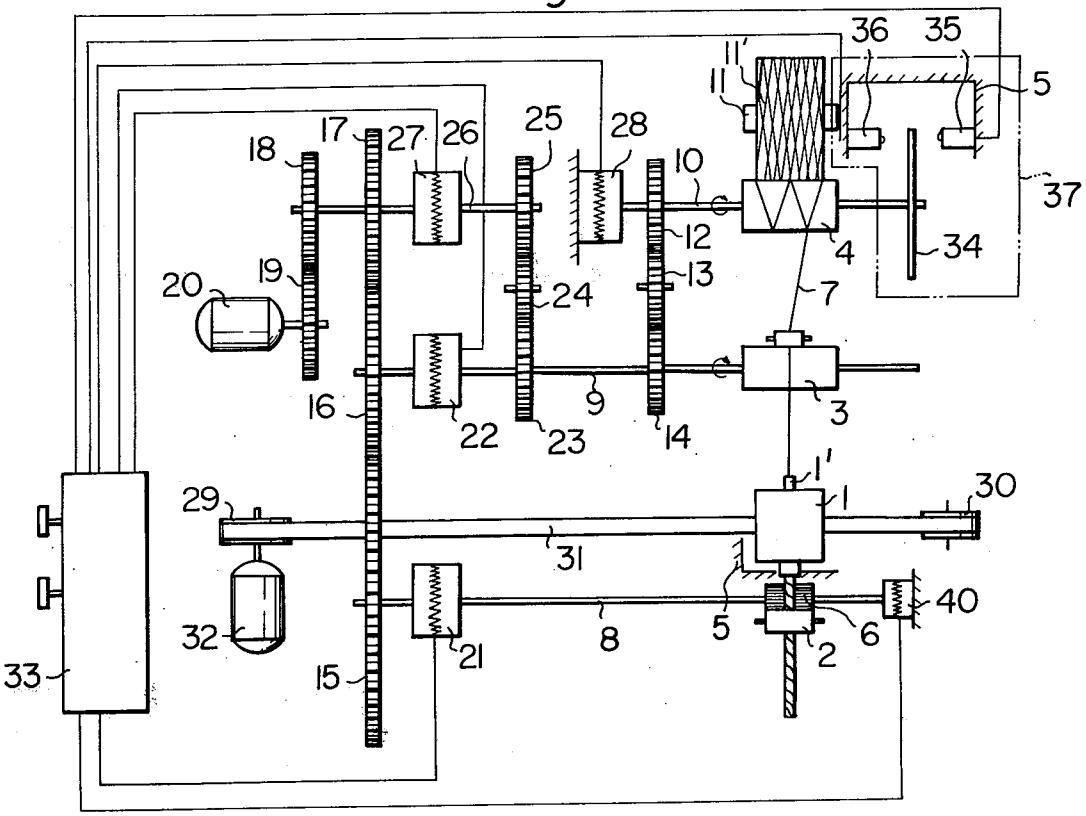
FIG. 2 is a gear diagram of the driving mechanism which involves a timing means according to the present invention.

For the sake of a clearer understanding of the gist of the present invention, the method and apparatus for controlling the driving operation of the component elements, are firstly explained in detail with reference to FIGS. 1 and 2. It should be noted that a gear diagram of the driving mechanism with the exception of a block 37, which is surrounded by a chain and dot line in FIG. 2, is the same as a conventional gear diagram of the driving mechanism. Accordingly the gear diagram of the driving mechanism provided with the block 37, as shown in FIG. 2, shows an embodiment according to the present invention. Further, although the open-end spinning frame is usually provided with a plurality of spinning units, an open-end spinning frame which is provided with only one spinning unit, is shown in FIG. 2. In FIG. 2, a spinning unit is comprised of a spinning rotor 1, a fiber supply roller means 2, provided with a fiber supply roller 6 a take-up roller means 3 which delivers a yarn from the spinning rotor 1, and a winding roller 4 which forms a yarn package on a bobbin 11 from the yarn delivered from the take-up roller means 3. The spinning rotor 1 is rotatably mounted to a frame 5. Fibers which have been supplied from a fiber supply roller 6, are combed by a combing device (not shown) and then fed to the spinning rotor 1, the inside of which is at a negative pressure, through a fixed feed pipe (not shown) of the spinning rotor 1. A yarn 7 is drawn from the spinning rotor 1 by the take-up roller means 3 through a delivery tube 1′ and is wound with a traverse motion by the winding roller 4. Then the yarn 7 is wound around the bobbin 11 and forms a yarn package 11′ thereon which is rotatably urged against on the winding roller 4 and rotates together with the winding roller 4 by the help of the friction between the surfaces of the winding roller 4 and the yarn package 11′. Both a shaft 9 of the take-up roller 3 and a shaft 10 of the winding roller 4 are rotated in the same direction by way of the gear trains 12, 13 and 14. Each of the shafts 9 and 10 is rotatably supported by a bearing (not shown) which is fixed to the frame 5. The two shafts 9 and 10 are driven by an electric motor 20. Each shaft is driven in a normal direction by the motor 20 by way of a magnetic clutch 22, which is mounted on the shaft 9. Each shaft is driven by the motor 20 in the reverse direction by way of a magnetic clutch 27 which is mounted on a shaft 26. Gear trains 16, 17, 18, 19, 23, 24 and 25 are provided as driving gear trains, but the latter gear trains 23, 24 and 25 are used only in case it is required to drive the shaft 9 in the reverse direction. A shaft 8 of the fiber supply roller 6 is driven by the gear 16 by way of a gear 15 and a magnetic clutch 21. The shaft 8 of the fiber supply roller 6 and the shaft 10 of the winding roller 4 are provided with a brake 40 and a brake 28, respectively. The brakes 28 and 40 are controlled by an electric control circuit 33. An electric motor 32 drives the spinning rotor 1 by means of an endless belt 31 which is slidably bridged between a wheel 30 and a wheel 29. It should be noted that the endless belt 31 also drives other spinning rotors which belong to respective open-end spinning units, however, other open-end spinning units are not shown in FIG. 2.

Figure 6A:
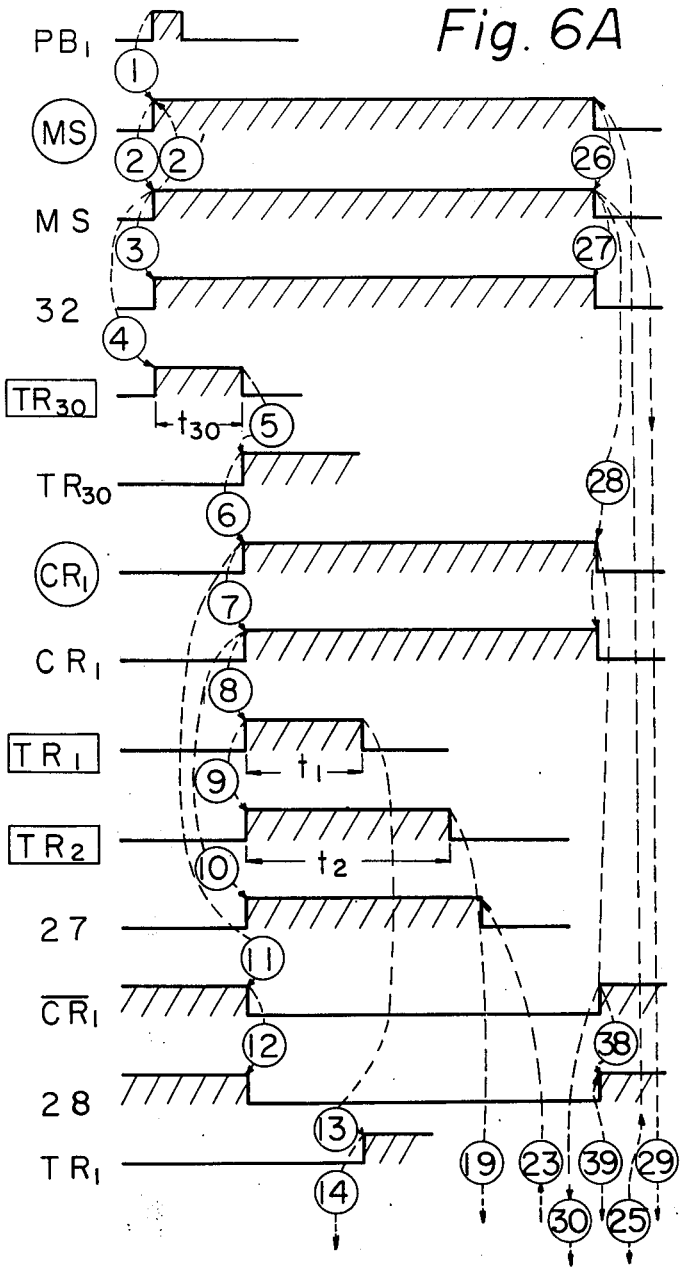
FIGS. 6A and 6B are timing charts of the conventional driving mechanism.
Figure 6B:
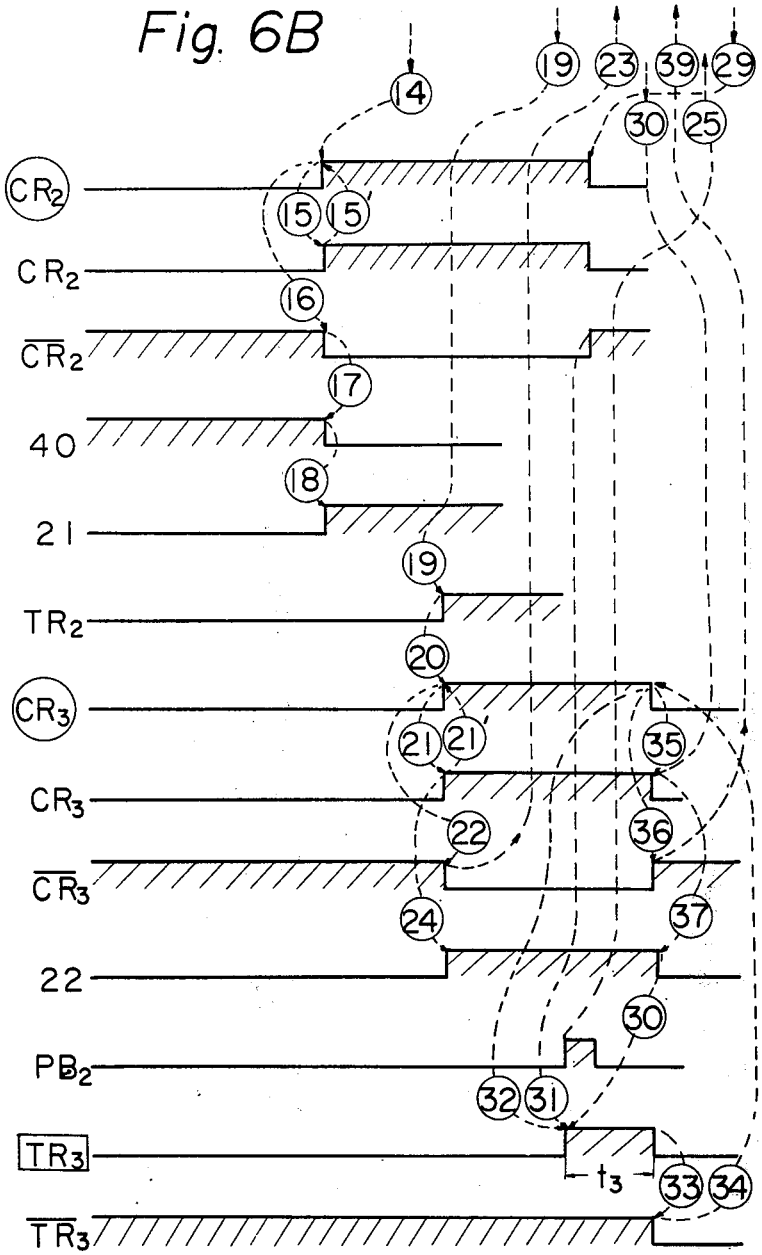

The driving operation of the open-end spinning unit shown in FIG. 2, is explained below with reference to FIG. 1 and FIGS. 6A and 6B. FIG. 1 is a diagram of an electric circuit utilized with a conventional timing means for controlling the conventional open-end spinning unit, which electrical circuit corresponds to the driving mechanism shown in FIG. 2 except for the block 37. FIGS. 6A and 6B are timing charts of the conventional driving mechanism shown in FIG. 2 except for the block 37. In FIG. 1, when the starting button switch $PB_1$ is operated, an electromagnetic switch (MS) is energized (along a route (1)). Then make-contactors MS become conductive (along a route (2)) and the electric motor 32 and the electric motor 20 (not shown in FIG. 1) are energized (along a route (3)). At the same time the electromagnetic switch (MS) is held in an energized condition through its make-contactor MS (route (2)′) whether the switch $PB_1$ is released or not. At this time an auxiliary timer $\boxed{TR_{30}}$ is energized through the make-contactor MS (route (4)). When a preset time $t_{30}$ which has been preset in the auxiliary timer $\boxed{TR_{30}}$ has passed, the auxiliary timer $\boxed{TR_{30}}$ makes its make-contactor $TR_{30}$ conductive (route (5)). Then, an electromagnetic relay ($CR_1$) is energized through the make-contactor $TR_{30}$ which is conductive now (route (6)), and make-contactor $CR_1$ becomes conductive (route (7)). At this time timers $\boxed{TR_1}$ and $\boxed{TR_2}$ are energized through the make-contactor $CR_1$ (route (8) and route (9)). Since the electromagnetic clutch 27 is energized through the make-contactor $CR_1$ which is conductive now and a break-contactor $CR_3$ (route (10)), and the electromagnetic brake 28 is released through a break-contactor $\overline{CR}_1$ (route (12)) which is non-conductive now (route (11)), both the take-up roller means 3 (FIG. 2) and the winding roller 4 (FIG. 2) start to rotate in the reverse direction from normal. During the reverse operation, a tail end of a leading yarn 7 is introduced into the spinning rotor 1 in order to automatically join it with a leading end of a fresh yarn formed in the spinning rotor 1.

Referring to FIGS. 1, 2, 6A and 6B, when a time $t_1$ preset in the timer $\boxed{TR_1}$ has passed, the timer $\boxed{TR_1}$ makes its make-contactor $TR_1$ conductive (route (13)). Then, an electromagnetic relay ($CR_2$) is energized through the make-contactor $TR_1$, which is conductive now, (route (14)) and makes its make-contactor $CR_2$ and break-contactor $\overline{CR}_2$ conductive (route (15)) and non-conductive (route (16)) respectively. At the same time the electromagnetic relay ($CR_2$) is held in an energized condition through the make-contactor $CR_2$, which is conductive now, (route (15)′) whether the make-contactor $TR_1$ is released or not. At this time the electromagnetic brake 40 is released by the break-contactor $\overline{CR}_2$ which is non-conductive now (route (17)) and the electromagnetic clutch 21 is energized through the make-contactor $CR_2$ which is conductive now (route (18)), whereby the fiber supply roller 6 (FIG. 2) starts to rotate. Thereafter, the fibers are accumulated in the spinning rotor 1 (FIG. 2). Then a leading end of the fresh yarn formed in this spinning rotor 1, can be automatically joined to the tail end of the leading yarn 7 (FIG. 2) which has already been introduced into the spinning rotor 1 (FIG. 2), whereby a tying operation is completed.

Referring again to FIGS. 6A and 6B, when a time $t_2$ preset in the timer $\boxed{TR_2}$ has passed, the timer $\boxed{TR_2}$ makes its make-contactor $TR_2$ conductive (route (19)). Then, an electromagnetic relay ($CR_3$) is energized through the make-contactor $TR_2$, which is conductive now (route (20)), and makes its make-contactor $CR_3$ conductive (route (21)) and break-contactor $\overline{CR}_3$ non-conductive (route (22)). At the same time the electromagnetic relay ($CR_3$) is held in an energized condition through the make-contactor $CR_3$, which is conductive now (route (21)′), whether the make-contactor $TR_2$ is released or not. At this time the electromagnetic clutch 27 is released by the break-contactor $\overline{CR}_3$, which is non-conductive now (route (23)), and the electromagnetic clutch 22 is energized through the make-contactor $CR_3$, which is conductive now (route (24)), whereby both the take-up roller means 3 (FIG. 2) and the winding roller 4 (FIG. 2) start to rotate in the normal direction. Thereafter, the normal spinning operation of the open-end spinning unit (frame) begins.

Referring once more to FIGS. 6A and 6B, when it is required to stop the spinning operation, a stop button switch $PB_2$ is operated and, then, the electromagnetic switch (MS) is released (route (25)). Accordingly, the make-contactor MS becomes non-conductive (route (26)) and the energization of the electric motor 32 is stopped by the non-conductive make-contactor MS (route (27)). At this time the electromagnetic relays ($CR_1$) and ($CR_3$) are both released (route (28) and route (29)). Then, the electromagnetic clutch 21 is released and the electromagnetic brake 40 is energized, whereby the fiber supply roller 6 (FIG. 2) stops supplying the fibers to the spinning rotor 1 (FIG. 2).

Again referring to FIGS. 6A and 6B, a timer $\boxed{TR_3}$ is energized through the break-contactors $\overline{CR_1}$ and $\overline{CR_2}$, which are conductive now (route ㉚ and route ㉛), and the make-contactor $CR_3$ which has already been made conductive (route ㉜). When a time $t_3$, preset in the timer $\boxed{TR_3}$ has passed, the timer $\boxed{TR_3}$ makes its break-contactor $\overline{TR_3}$ non-conductive (route ㉝). Then, the electromagnetic relay $CR_3$ is released by the break-contactor $\overline{TR_3}$, which is non-conductive now (route ㉞), and the make-contactors $CR_3$ and the break-contactors $\overline{CR_3}$ become non-conductive and conductive, respectively (route ㉟ and route ㊱). At this time, the electromagnetic clutch 22 is released by the make-contactor $CR_3$, which is non-conductive now (route ㊲), the electromagnetic brake 28 is energized through the break-contactor $\overline{CR_1}$, which is conductive now (route ㊳), and the break-contactor $\overline{CR_3}$, which is conductive now (route ㊴), whereby the take-up roller means 3 (FIG. 2) and the winding roller 4 (FIG. 2) suddenly stop rotating. It should be noted that the duration of said preset time $t_3$ of the timer $\boxed{TR_3}$ has to be selected so as to be within the time during which a tail end of the yarn 7 taken up by the take-up roller means 3 (FIG. 2) still remains in the delivery tube 1' (FIG. 2) of the spinning rotor 1 (FIG. 2). As mentioned before, such tail end remaining in the delivery tube make it easy to join it to the fibers accumulated in the spinning rotor 1 when the next spinning operation is commenced.

As mentioned above, when it is required to start the spinning operation, the duration of time between the time at which both the take-up roller 3 and the winding roller 4 start to rotate in the reverse direction and the time at which the fiber supply roller 6 starts to supply the fiber, is preset by the timer $\boxed{TR_1}$, and; the duration of time between the time at which both the take-up roller means 3 and the winding roller 4 start to rotate in the reverse direction and the time at which both the roller means 3 and the roller 4 change their rotating direction from the reverse direction to normal direction, is preset by the timer $\boxed{TR_2}$; while, when it is required to stop the spinning operation, a delay of the time at which the winding roller 4 stops rotating until after the time when the stop button switch is operated and the fiber supply roller 6 stops rotating, is preset by the timer $\boxed{TR_3}$. Consequently, the above-mentioned timing relation of the conventional spinning operation is carried out by the preset times, such as $t_1$, $t_2$ and $t_3$ (shown in FIG. 6A and 6B). However, the above-mentioned timing relation should not be set by preset times but should be set by a preset amount of yarn, that is a preset length of yarn. This is because, according to our experience, the pertinent condition of the above-mentioned timing relation should be changed to fit the variable conditions which are due to the variety of fiber materials, spinning count of yarn, production speed, etc. Accordingly, it should be noted that it is very difficult to find the practical and pertinent condition of the timing relation when the timing relation is set by the preset time. For example, when it is required to start the spinning operation, a tail end of leading yarn is reliably joined with a fresh yarn in the spinning rotor 1 if a preset length of the tail end of leading yarn is accurately introduced into the spinning rotor 1. However, with the prior art it is difficult to join the tail end of leading yarn reliably with the fresh yarn in the spinning rotor 1 when the tail end of leading yarn is introduced into the spinning rotor 1 by relying only on a duration of time which has been preset into a timer.

Figure 4:
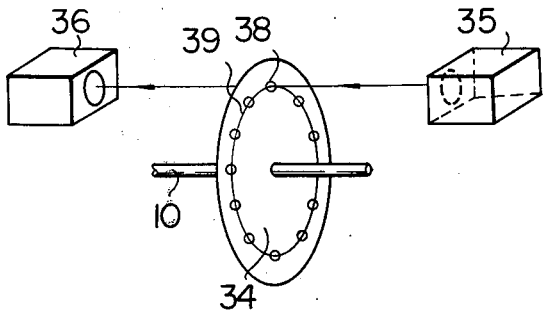
FIG. 4 is a perspective view of a timing means utilized with the embodiment shown in FIGS. 2 and 3.

The basic idea of the present invention lies in the point that the above-mentioned timing relation should be set by a preset amount (length) of yarn. In FIG. 2, the basic idea of the present is realized by a timing means 37. The timing means 37 is comprised of a lamp 35 and a photocell 36, which are mounted on the above-mentioned frame 5 and form a photocoupler, and a disc 34 which is attached to the shaft 10 and rotates together with this shaft 10. These timing elements of the timing means 37 are arranged as shown in FIG. 4. As can be seen in FIG. 4, the disc 34 has a plurality of through holes 38 disposed at a constant pitch along a circle 39 with its center at the shaft 10. When the disc 34 rotates together with the winding roller 4, the photocoupler (35, 36) detects each through hole 38 passing the line between the elements 35 and 36. The detected signal from the photocoupler is applied to a photo-switch in the electric control circuit 33 (FIG. 2).

Figure 3:
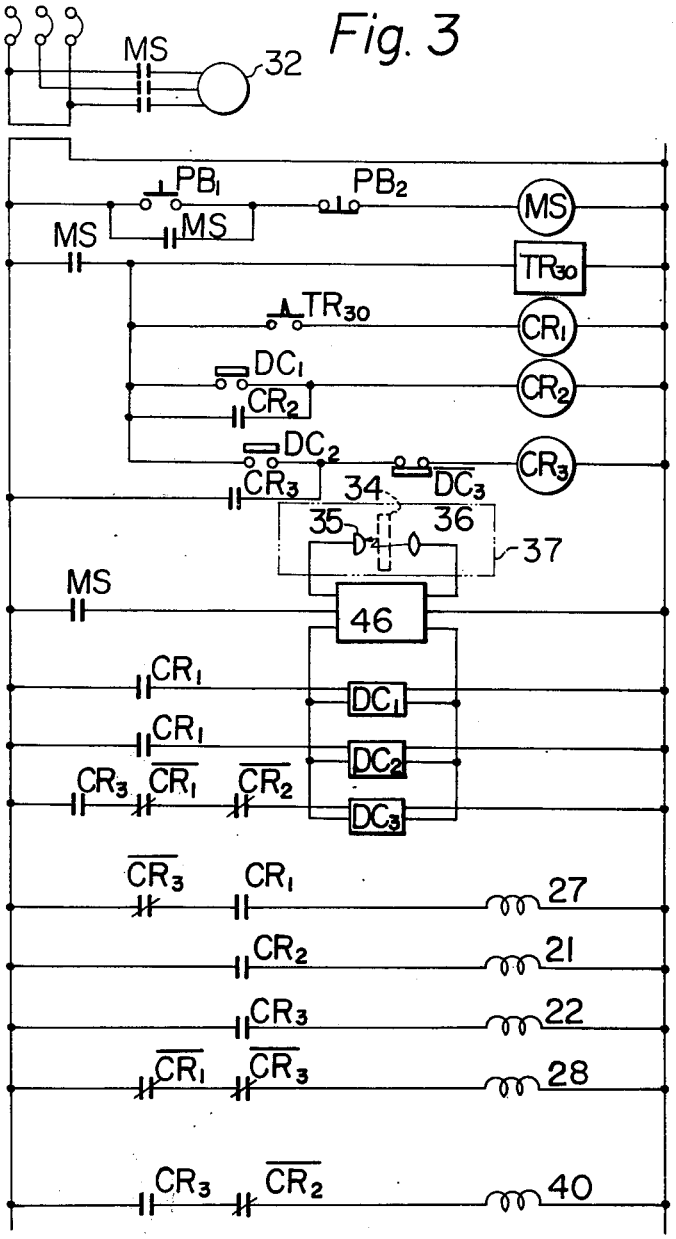
FIG. 3 is a diagram of an electric circuit utilized with the driving mechanism shown in FIG. 2.
Figure 7:
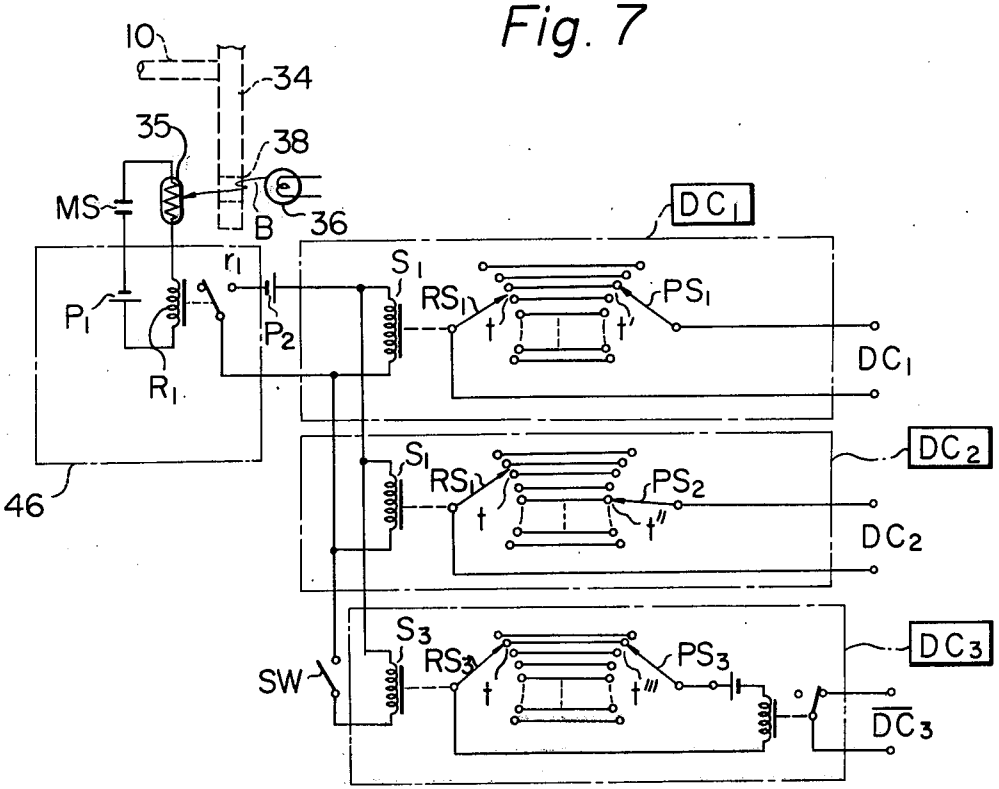
FIG. 7 shows one example of a circuit block diagram of preset counters utilized in the present invention.

The improved driving operation of an open-end spinning frame equipped with the present invention, including the timing means 37 as shown in FIG. 2, is explained below with reference to FIG. 3. FIG. 3 is a diagram of an electric circuit for controlling the open-end spinning frame according to the present invention. Since a timing chart of the driving mechanism shown in FIG. 2 is basically the same as that of the conventional driving mechanism which has explained previously by referring FIG. 2, except for the timing means 37, a timing chart solely for the driving mechanism according to the present invention is not included. As will be seen from a comparison of FIGS. 1 and 3, the timers $\boxed{TR_1}$, $\boxed{TR_2}$ and $\boxed{TR_3}$ are not shown in FIG. 3, however, they are replaced by the timing means 37, the photo-switch 46 which cooperates with the photocoupler (35, 36), and preset counters $\boxed{DC_1}$, $\boxed{DC_2}$ and $\boxed{DC_3}$ as shown in FIG. 3. FIG. 7 shows one example of a circuit connection between the elements 35, 36, 46, $\boxed{DC_1}$ $\boxed{DC_2}$ and $\boxed{DC_3}$. In FIG. 7, when the disc 34 rotates, a beam B from the lamp 36 reaches the photocell 35 every time a through hole 38 is aligned with a line between the lamp 36 and the photocell 35. Every time the beam B reaches the photocell 35, the photocell 35 becomes conductive and a relay $R_1$ is energized by a power source $P_1$. At this time a make-contactor $r_1$ becomes conductive and solenoids $S_1$, $S_2$ and $S_3$ are energized by a power source $P_2$. Then, the solenoids $S_1$, $S_2$ and $S_3$ actuate respective actuators of respective rotary switches $RS_1$, $RS_2$ and $RS_3$. Each actuator of respective rotary switches $RS_1$, $RS_2$ and $RS_3$ steps to the next terminal every time a through hole 38 is alligned with a line between the lamp 36 and the photocell 35. Consequently, the rotary switches $RS_1$, $RS_2$ and $RS_3$ of the preset counters $\boxed{DC_1}$, $\boxed{DC_2}$ and $\boxed{DC_3}$, count the number of rotations of the rotating shaft 10 and, accordingly, count the number of rotations of the rotating winding roller 4. On the other hand, a contactor of a preset switch $PS_1$ of the preset counter $\boxed{DC_1}$ is previously fixed to one predetermined terminal $t'$ and similarly contactors of preset switches $PS_2$ and $PS_3$ of preset counters $\boxed{DC_2}$ and $\boxed{DC_3}$, respectively, are previously fixed to predetermined terminals $t''$ and $t'''$, respectively. Accordingly, when the actuators of rotary switches $RS_1$, $RS_2$ and $RS_3$ encounter the respective terminals $t'$, $t''$ and $t'''$ of the preset switches $PS_1$, $PS_2$ and $PS_3$, respectively, a make-contactor $DC_1$ of the preset counter $\boxed{DC_1}$ and a make-contactor $DC_2$ of the preset counter $\boxed{DC_2}$ become conductive, and a break-contactor $DC_3$ of the preset counter $\boxed{DC_3}$ becomes non-conductive. In FIG. 3, when the starting button switch $PB_1$ is operated, an electromagnetic switch (MS) is energized. Then, make-contactors MS become conductive and the electric motor 32 and the electric motor 20 (not shown in FIG. 3) are energized. At the same time, the electromagnetic switch (MS) is held in an energized condition through its make-contactor MS whether the switch $PB_1$ is released or not. At this time, an auxiliary timer $\boxed{TR_{30}}$ is energized through the make-contactor MS. When a time $t_{30}$ (shown in FIG. 6) preset in the auxiliary timer $\boxed{TR_{30}}$ has passed, the auxiliary timer $\boxed{TR_{30}}$ makes it make-contactor $TR_{30}$ conductive. Then, an electromagnetic relay ($CR_1$) is energized through the make-contactor $TR_{30}$ which is conductive now, and make-contactors $CR_1$ become conductive. Since the electric motor 32 is energized through the make-contactor MS, which is conductive now, and the photo-switch 46 is also energized through the make-contactor MS, the relay $R_1$ of the photo-switch 46 (FIG. 7) makes its contactor $r_1$ conductive or non-conductive in accordance with the frequency of passage of the through holes on the disc 34. At this time the disc 34, which rotates together with the winding roller 4, rotates in the reverse direction. This is because, the electromagnetic clutch 27 is energized through the make-contactor $CR_1$, which is conductive now, and a break-contactor $CR_3$, and the electromagnetic brake 28 (FIGS. 2 and 3) is released through a break-contactor $\overline{CR_1}$ which is, non-conductive now. Consequently, the winding roller 4 rotates in the reverse direction by way of the gear trains 25, 24, 23 and 14, 13, 12 (FIG. 2), and the shaft 10. During the reverse operation, a tail end of a leading yarn 7 is introduced into the spinning rotor 1 in order to automatically join it with a leading end of a fresh yarn formed in the spinning rotor 1.

When a count preset in the preset counter $\boxed{DC_1}$ has been counted in other words when the actuator of the rotary switch $RS_1$ (FIG. 7) steps and reaches a terminal $t$ (FIG. 7) which is electrically shorted to the terminal $t'$ (FIG. 7), the preset counter $\boxed{DC_1}$ makes its make-contactor $DC_1$ conductive. Then, an electromagnetic relay ($CR_2$) is energized through the make-contactor $DC_1$, which is conductive now, and makes its make-contactors $CR_2$ and break-contactors $\overline{CR_2}$ conductive and non-conductive, respectively. At the same time the electromagnetic relay ($CR_2$) is held in an energized condition through the make-contactor $CR_2$, which is conductive now, whether the make-contactor $DC_1$ is released or not. At this time the electromagnetic brake 40 is released by the break-contactor $\overline{CR_2}$, which is non-conductive now, and the electromagnetic clutch 21 is energized through the make-contactor $CR_2$, which is conductive now, whereby the fiber supply roller 6 (FIG. 2) starts to rotate. Thereafter, the fibers are accumulated in the spinning rotor 1 (FIG. 2). Then a leading end of the fresh yarn formed in this spinning rotor 1 can be automatically joined to the tail end of the leading yarn 7 (FIG. 2) which has already been introduced into the spinning rotor 1 (FIG. 2), whereby a tying operation is completed.

When a count preset in the preset counter $\boxed{DC_2}$ has been counted, in other words when the actuator of the rotary switch $RS_2$ (FIG. 7) steps and reaches a terminal $t'''$ (FIG. 7) which is electrically shorted to the terminal $t''$ (FIG. 7), the preset counter $\boxed{DC_2}$ makes its make-contactor $DC_2$ conductive. Then, an electromagnetic relay ($CR_3$) is energized through the make-contactor $DC_2$, which is conductive now, and makes its make-contactors $CR_3$ and break-contactors $\overline{CR_3}$ conductive and non-conductive, respectively. At the same time the electromagnetic relay ($CR_3$) is held in an energized condition through the make-contactor $CR_3$, which is conductive now, whether the make-contactor $DC_2$ is released or not. At this time the electromagnetic clutch 27 is released by the break-contactor $\overline{CR_3}$, which is non-conductive now, and the electromagnetic clutch 22 is energized through the make-contactor $CR_3$, which is conductive now, whereby both the take-up roller means 3 (FIG. 2) and the winding roller 4 (FIG. 2) start to rotate in the normal direction. Thereafter, the normal spinning operation of the open-end spinning frame begins.

When it is required to stop the spinning operation, a stop button switch $PB_2$ is operated and then the electromagnetic switch (MS) is released. Accordingly, the make-contactors MS become non-conductive and the electric motor 32 is stopped being energized by the make-contactor MS, which is non-conductive now. At this time the electromagnetic relays ($CR_1$) and ($CR_2$) are both released. Then, the electromagnetic clutch 21 is released and the electromagnetic brake 40 is energized, whereby the fiber supply roller 6 (FIG. 2) stops supplying the fibers to the spinning rotor 1 (FIG. 2). At this time break-contactors $CR_1$ and $CR_2$ are conductive and make-contactor $CR_3$ has already been made conductive (these contactors correspond to switch SW in FIG. 7), whereby the actuator of the rotary switch $RS_3$ (FIG. 7) in the preset counter $\boxed{DC_3}$ is stepped. When the actuator of the rotary switch $RS_3$ steps and reaches a terminal $t$ (FIG. 7) which is electrically shorted to the terminal $t'''$ (FIG. 7), a relay $R_2$ (FIG. 7) is energized, and its break-contactor $r_2$, that is the break-contactor $\overline{DC_3}$, becomes non-conductive. Consequently, the electromagnetic relay ($CR_3$) is released by the break-contactor $\overline{DC_3}$, which is non-conductive now. Then, the electromagnetic clutch 22 is released by the make-contactor $CR_3$, which is non-conductive now, and at the same time the electromagnetic brake 28 is energized through the break-contactor $\overline{CR_1}$, which has already been made conductive, and the break-contactor $\overline{CR_3}$, which is conductive now. As a result the take-up roller means 3 (FIG. 2) and the winding roller 4 (FIG. 2) suddenly stop rotating. Thus, the time when the take-up roller means 3 and the winding roller 4 stop is delayed with respect to the time the fiber supply roller 6 stops. It should be noticed that the preset count $t'''$ of the preset counter $\boxed{DC_3}$ has to be selected so as to be an amount of a tail end of the yarn which can still remain in the delivery tube 1' (FIG. 2). Such tail end remaining in the delivery tube 1' makes it easy to joint it to the fibers accumulated in the spinning rotor 1 when the next spinning operation is commenced.

As mentioned-above, since the timing relation is set by the preset amount of yarn, the pertinent condition of the timing relation which fits variable conditions due to the variety of fiber materials, spinning count of yarn, production speed, etc., is obtained by the present invention. Further, since the tying operation and the normal spinning operation can not be provided at the same time in each spinning unit, operation error can no occur. Accordingly, working efficiency is very high. Further, since the timing relation is decided by using the preset amount (or length) of yarn, slip or a time lag in the operation of the electromagnetic clutches are not relevant to the tying and the normal spinning operation of the open-end spinning frame. Furthermore, the present invention can easily be used with a conventional open-end spinning frame.

Figure 5:
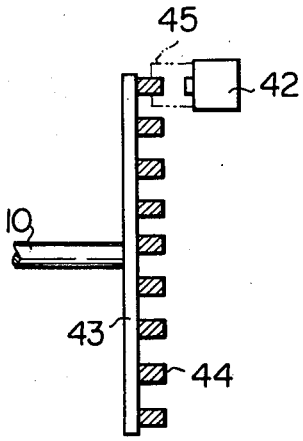
FIG. 5 is a schematic side view of the modified timing means according to the present invention.

The timing means 37 can also be realized by other well-known devices. One example is shown in FIG. 5. In FIG. 5 reference numeral 43 corresponds to the disc 34 (FIG. 4), which is preferably made of non-magnetic material. Reference numeral 44 indicates some type of magnetic material disposed on the disc 43 in an arrangement corresponding to that of the through holes 38 as shown in FIG. 4. A well-known switch 42, which is sensitive to a magnetic material, is fixed to the frame 5. The chain and dot line 45 defines a domain in which the switch 42 can reliably sense and detect the magnetic material 44. The switch 42 in FIG. 5 can be a well-known reed switch. In this case, the members 44 should be formed by permanent magnets. Further, the timing means 37 can also be attached, for example, to the shaft 9, or can be realized by using a counter which counts, for example, the number of teeth which pass a predetermined fixed point.

What is claimed is:

1. In an apparatus for controlling the driving operation of an open-end spinning frame provided with a plurality of spinning units, a common driving motor for driving all the spinning units and driving gear trains for transmitting driving power from said common driving motor to each spinning unit, each spinning unit comprising a spinning rotor, a roller means for supplying fibers into said spinning rotor, a take-up roller means for delivering a yarn from said spinning rotor and a winding roller for forming a yarn package from said yarn delivered from said take-up roller means, an improved apparatus comprising, means for measuring the length of the yarn delivered from said spinning rotor, electromagnetic clutches which selectively transfer rotating power or stop transferring rotating power to said take-up roller means, winding roller or said roller means, for supplying fibers independently and selectively with said gear trains, electromagnetic brakes which stop the rotation of said take-up roller means, winding roller means for supplying fibers, an electric control circuit means for selectively energizing or releasing said electromagnetic clutches or said electromagnetic brakes under control of an output signal from said means for measuring the length of the yarn delivered from the spinning rotor in accordance with a predetermined program, said electric control circuit comprising means operative in response to the start of the driving operation of said spinning units for supplying reverse driving signals to both said take-up roller means and said winding roller, for supplying following a predetermined time after the start of the driving operation, forward driving signals to said roller means for supplying fibers and, following a predetermined time after the roller means for supplying fibers is energized, for supplying a stop motion followed by a forward motion signal to both said take-up roller means and said winding roller said electric control circuit means further comprising means operative in response to stopping the driving operation of said spinning units, for supplying a braking signal to said roller means for supplying fibers and, following a predetermined time after supplying said braking signal to said roller means for supplying fibers, for supplying braking signals to both said take-up roller means and said winding roller.

2. In an apparatus for controlling the driving operation of an open-end spinning frame provided with a plurality of spinning units, a common driving motor for driving all the spinning units and driving gear trains for transmitting driving power from said common driving motor to each spinning unit, each spinning unit comprising a spinning rotor, a roller means for supplying fibers into said spinning rotor, a take-up roller means for delivering a yarn from said spinning rotor and a winding roller for forming yarn package from said yarn delivered from said take-up roller means, an improved apparatus comprising means located on a shaft of at least one of said take-up roller means and said winding roller for counting the number of rotations of said take-up roller means and said winding roller thereby to measure the length of the yarn delivered from said rotor, electromagnetic clutches for selectively transferring rotating power or stopping the transfer of rotating power to said take-up roller means, winding roller or said roller means for supplying fibers independently and selectively with said gear trains' electromagnetic brakes which stop the rotation of said take-up roller means, winding roller or roller means for supplying fibers, and electric control circuit means for selectively energizing or releasing said electromagnetic clutches or said electromagnetic brakes under control of an output signal from said means for counting the number of rotations in one of said take-up roller means and said winding roller in accordance with a predetermined program, said electric control circuit comprising means operative in response to the start of the driving operation of said spinning units for supplying reverse driving signals to both said take-up roller means and said winding roller, for supplying following a predetermined time after the start of the driving operation, forward driving signals to said roller means for supplying fibers and, following a predetermined time after the roller means for supplying fibers is energized, for supplying a stop motion followed by a forward motion signal to both said take-up roller means and said winding roller, said electric control circuit means further comprising means operative in response to the stopping of the driving operation of said spinning units for supplying a braking signal to said roller means for supplying fibers and, following a predetermined time after supplying said braking signal to said roller means for supplying fibers, for supplying braking signals to both said take-up roller means and said winding roller.

3. An apparatus according to claim 2, wherein said means for measuring the length of the yarn delivery delivered from said spinning rotor, comprising a disc which is attached to a shaft of one of said take-up roller means and winding roller and has a plurality of through-holes with predetermined constant pitch along a circle with its center at said shaft, a photo-coupler which is fixed to a frame and faces said disc, and a photo-switch which cooperates with said photo-coupler.

4. An apparatus according to claim 2, wherein said means for measuring the length of the yarn delivered from said spinning rotor is mounted to the shaft of said take-up roller means.

5. An apparatus according to claim 2, wherein said means for measuring the length of the yarn delivered from said spinning rotor is mounted to the shaft of said winding roller.

6. An apparatus according to claim 2, wherein said electric control circuit comprises, an electromagnetic switch (MS) which is energized through a starting switch $PB_1$, a common driving motor 32 which is energized through a contactor MS of said electromagnetic switch (MS), said rotation counting means comprising a photo-switch 46 which is energized through the contactor MS, a photocoupler 37 which operates said photo-switch 46, first, second and third preset counters $\boxed{DC_1}$, $\boxed{DC_2}$, and $\boxed{DC_3}$ which cooperate with said photo-switch 46, an auxiliary timer $\boxed{TR_{30}}$ which is energized through said contactor MS, a first electromagnetic relay ($CR_1$) which is energized through a contactor $TR_{30}$ of said auxiliary timer $\boxed{TR_{30}}$, a second electromagnetic relay ($CR_2$) which is energized through a contactor $DC_1$ of said first preset counter $\boxed{DC_1}$ and is self latched through its contactor $CR_2$, a third electromagnetic relay ($CR_3$) which is energized through a contactor $DC_2$ of said second preset counter $\boxed{DC_2}$ and is deenergized through a contactor $DC_3$ of said third preset counter $\boxed{DC_3}$ and is self latched through its contactor $CR_3$, a first electromagnetic clutch 27 which is energized through a contactor $CR_3$ of said third electromagnetic relay ($CR_3$) and the contactor $CR_1$ for operating said winding roller, a second electromagnetic clutch 21 which is energized through the contactor $CR_2$ for operating the roller means for supplying fibers, a third electromagnetic clutch 22 which is energized through the contactor $CR_3$ for operating said take-up roller, a first electromagnetic brake 28 which is energized through the contactor $CR_1$ and $CR_3$ for stopping said take-up roller and said winding roller, a second electromagnetic brake 40 which is energized through the contactors $CR_2$ and $CR_3$ for stopping said fiber supply roller.

7. In an apparatus for controlling the driving operation of an open-end spinning frame provided with a plurality of spinning units, each spinning unit comprising a spinning rotor, a roller means supplying fibers into said spinning rotor, a take-up roller means for delivering a yarn from said spinning rotor and a winding roller for forming a yarn package from said yarn delivered from said take-up roller means, the improvement comprising means for measuring the length of the yarn delivered from said take-up roller means at the time of stopping and starting the driving motion of said spinning units, means for controlling the relative timing of reverse rotation of said take-up roller means and said winding roller in response to the starting of said fiber supply roller and the time of starting the driving of said take-up roller and the measured length of said yarn and for controlling the relative timing of the time of stopping the driving of said take-up roller means and said winding roller in response to the stopping of said fiber supply means and the measured length of said yarn.

8. In an apparatus for controlling the driving operation of an open end spinning frame provided with a plurality of spinning units, a common driving motor for driving all the spinning units and driving gear trains for transmitting driving power from said common driving motor to each spinning unit, each spinning unit comprising a spinning rotor, a roller means for supplying fibers to said spinning rotor, a pick up roller means for delivering the yarn from said spinning rotor and a winding roller for forming a yarn package from said yarn delivered from said take-up roller means, an improved apparatus comprising means located proximate a shaft of said winding roller for counting the number of rotations of one of the take-up roller means and the winding roller thereby measuring the length of yarn delivered from said spinning rotor, electromagnetic clutches for selectively transferring rotating power or for stopping the transfer rotating power to said take-up roller means, winding roller or said roller means for supplying fibers independently and selectively with said gear trains, electromagnetic brakes for stopping the rotation of said take-up roller means, winding roller or roller means for supplying fibers, an electric control circuit means for selectively energizing or releasing said electromagnetic clutches or said electromagnetic brakes under control of an output signal from said means for counting the number of rotations of one of said take-up roller means and said winding roller in accordance with a predetermined program, said electric control circuit comprising means operative in response to the start of the driving operation of said spinning units for supplying reverse driving signals to both said take-up roller means and said winding roller, for supplying following a predetermined time after the start of the driving operation, forward signals to said roller means for supplying fibers and, following a predetermined time after the roller means for supplying fibers is energized, for supplying a stop motion followed by a forward motion signal to both said take-up roller means and said winding roller, said electric control circuit means further comprising means operative in response to stopping the driving operation of said spinning units for supplying a braking signal to said roller means for supplying fibers, and following a predetermined time after supplying said braking signal to said roller means for supplying fibers, for supplying braking signals to both said take-up roller means and said winding roller.

* * * * *